US010458626B2

(12) United States Patent
Johnson, III et al.

(10) Patent No.: US 10,458,626 B2
(45) Date of Patent: Oct. 29, 2019

(54) LIGHT SYSTEMS INCLUDING FIELD REPLACEABLE ASSEMBLY, AND METHODS OF ASSEMBLING AND OPERATING THE SAME

(71) Applicant: Heraeus Noblelight America LLC, Gaithersburg, MD (US)

(72) Inventors: William E. Johnson, III, Burke, VA (US); Ruben C. Manikkam, Clarksburg, MD (US); Mahmood Gharagozloo, Gaithersburg, MD (US); Darrin Leonhardt, Gaithersburg, MD (US)

(73) Assignee: Heraeus Noblelight America LLC, Gaithersburg, MD (US)

( * ) Notice: Subject to any disclaimer, the term of this patent is extended or adjusted under 35 U.S.C. 154(b) by 3 days.

(21) Appl. No.: 15/873,458

(22) Filed: Jan. 17, 2018

(65) Prior Publication Data

US 2018/0216802 A1 Aug. 2, 2018

Related U.S. Application Data

(60) Provisional application No. 62/451,178, filed on Jan. 27, 2017.

(51) Int. Cl.
*F21V 21/00* (2006.01)
*F21V 19/00* (2006.01)
(Continued)

(52) U.S. Cl.
CPC ..... *F21V 19/0025* (2013.01); *F21V 29/51* (2015.01); *H05B 33/0803* (2013.01)

(58) Field of Classification Search
CPC ..... F21V 19/0025; F21V 29/51; F21V 29/56; F21V 29/713; F21V 19/04; H05B 33/0803; F21Y 2115/10
(Continued)

(56) References Cited

U.S. PATENT DOCUMENTS 5,388,039 A * 2/1995 Dolph ..... A01K 85/01 250/459.1
8,378,322 B2 * 2/2013 Dahm ..... F21V 29/30 250/496.1
(Continued)

FOREIGN PATENT DOCUMENTS

EP 2610014 7/2013
EP 3045319 7/2016
(Continued)

OTHER PUBLICATIONS

Search Report from corresponding European Patent Application No. 18153411.6 dated Mar. 26, 2018.

*Primary Examiner* — Laura K Tso
(74) *Attorney, Agent, or Firm* — Stradley Ronon Stevens & Young, LLP

(57) ABSTRACT

A light system is provided. The light system includes: (a) a lamp head assembly, the lamp head assembly including (i) driver circuits, and (ii) a cooling system; and (b) a replaceable assembly connected to the lamp head assembly, the replaceable assembly including (i) a plurality of light producing elements, (ii) a cooling structure for receiving a cooling fluid from the cooling system, the plurality of light producing elements being supported by the cooling structure, and (iii) a reflector for receiving light from the plurality of light producing elements. The replaceable assembly is separable, as a single assembly, from the lamp head assembly.

20 Claims, 3 Drawing Sheets

(51) Int. Cl.
*F21V 29/51* (2015.01)
*H05B 33/08* (2006.01)

(58) Field of Classification Search
USPC ..... 362/547, 264, 294, 373, 198, 199, 84
See application file for complete search history.

(56) References Cited

U.S. PATENT DOCUMENTS

| | | | | |
|---|---|---|---|---|
| 8,809,820 | B2 | 8/2014 | Dahm | |
| 9,648,705 | B2 | 5/2017 | Johnson, III et al. | |
| 2015/0378072 | A1* | 12/2015 | Sprankle ..... | G02B 5/208 359/359 |

FOREIGN PATENT DOCUMENTS

| | | |
|---|---|---|
| JP | 2015065057 | 4/2015 |
| WO | 2015060475 | 4/2015 |

* cited by examiner

LIGHT SYSTEMS INCLUDING FIELD REPLACEABLE ASSEMBLY, AND METHODS OF ASSEMBLING AND OPERATING THE SAME

CROSS-REFERENCE TO RELATED APPLICATION

This application claims the benefit of U.S. Provisional Patent Application No. 62/451,178, filed Jan. 27, 2017, the contents of which are incorporated herein by reference.

FIELD

The invention relates to light systems, and more particularly, to light systems including a field replaceable assembly, and methods of assembling and operating the same.

BACKGROUND

Certain light systems (e.g., including lamp head assemblies) include a plurality of light producing elements (e.g., ultraviolet radiation LEDs, also known as UV LEDs, etc.). Often, these light producing elements are arranged in a plurality of arrays, each of the arrays including a plurality of the light producing elements. Such light systems are used in connection with many applications such as, for example, UV curing applications (e.g., UV curing of inks, bonding agents such as adhesives, coatings, etc.), horticultural applications, and medical applications.

Such conventional light systems face certain challenges. For example, most LED based light systems are not designed with field replaceable components. Operators are often not trained in the troubleshooting, maintenance, and repair of such complicated light systems. Thus, if there is a failure of a subsystem (e.g., a failure in the cooling system, such as a water based cooling system, or a failure of a significant number of LEDs), the entire light system may need to be returned for service. Worse, the entire light system may be treated as a consumable, which is costly to the user.

Thus, it would be desirable to provide improved lamp head assemblies, and methods of assembling and operating the lamp head assemblies.

SUMMARY

According to an exemplary embodiment of the invention, a light system is provided. The light system includes: (a) a lamp head assembly, the lamp head assembly including (i) driver circuits, and (ii) a cooling system; and (b) a replaceable assembly connected to the lamp head assembly, the replaceable assembly including (i) a plurality of light producing elements, (ii) a cooling structure for receiving a cooling fluid from the cooling system, the plurality of light producing elements being supported by the cooling structure, and (iii) a reflector for receiving light from the plurality of light producing elements. The replaceable assembly is separable, as a single assembly, from the lamp head assembly.

According to another exemplary embodiment of the invention, a method of assembling a light system is provided. The method includes the steps of: (a) providing a lamp head assembly, the lamp head assembly including (i) driver circuits, and (ii) a cooling system; and (b) connecting a replaceable assembly to the lamp head assembly, the replaceable assembly including (i) a plurality of light producing elements, (ii) a cooling structure for receiving a cooling fluid from the cooling system, the plurality of light producing elements being supported by the cooling structure, and (iii) a reflector for receiving light from the plurality of light producing elements.

BRIEF DESCRIPTION OF THE DRAWINGS

The invention is best understood from the following detailed description when read in connection with the accompanying drawings. It is emphasized that, according to common practice, the various features of the drawings are not to scale. On the contrary, the dimensions of the various features are arbitrarily expanded or reduced for clarity. Included in the drawings are the following figures.

DETAILED DESCRIPTION

Figure 1A:
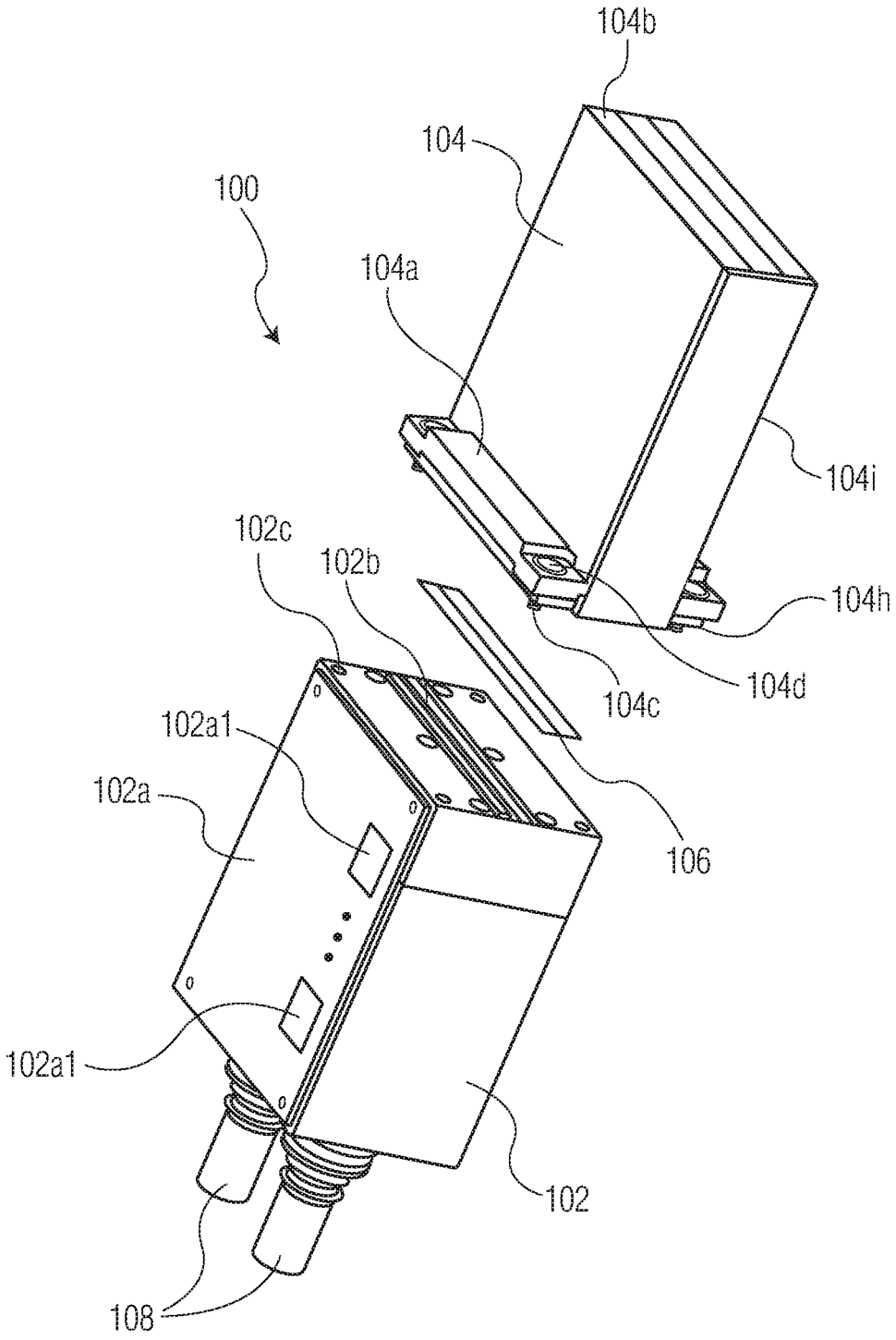
FIG. 1A is a perspective view of a light system including a lamp head assembly and a replaceable assembly in accordance with an exemplary embodiment of the invention.

As used herein, the terms "processor" and "microprocessor" are used interchangeably, and shall be broadly construed to refer to any device including a processing unit (e.g., a central processing unit) or other hardware that executes computer program instructions. Examples of "processors" and "microprocessors" include microcontrollers, digital signal processors (DSPs), programmable logic controllers (PLCs), computers, etc. As is understood by those skilled in the art, "processors" and "microprocessors" may include elements such as random access memory (RAM), read only memory (ROM), and peripherals.

As used herein, the term "captive" with respect to fasteners refers to a broad group of fasteners that are adapted/configured to be held (e.g., permanently fixed) in connection with an assembly (e.g., the replaceable assembly described herein, the lamp head assembly described herein, etc.). Such fasteners may provide a secure joining between the assembly to which it is held, and another component, without a risk of loss or damage to the fastener that may occur if it were not held captive to the assembly.

As used herein, the term "turnlock" with respect to fasteners refers to a broad group of fasteners that are used to easily secure a first component/assembly to a second component/assembly. Examples of such fasteners includes quarter-turn lock fasteners. Turnlock fasteners may also be referred to as quick-action, quick-connect, or quick disconnect fasteners. Turnlock fasteners may also be captive fasteners. Turnlock fasteners may also be configured to be operated without tools.

A technical objective of the invention is to design and build field replaceable assemblies for light systems, where such assemblies may includes arrays of light producing elements (e.g., LED light producing elements). Such designs may include various features such as: quick release (e.g., quarter turn) fasteners connecting a replaceable assembly to a lamp head assembly; limited accessibility by an operator to light producing elements (e.g., LEDs) and bond wires of the replaceable assembly; and capability to quickly disconnect a cooling fluid supply (e.g., chilled water, air cooling) from the replaceable assembly. As will be appreciated by those skilled in the art, passive cooling may be utilized, instead of (or in addition to) active cooling.

Exemplary elements included in a replaceable assembly according to the invention include: a reflector(s); a cooling structure for supporting light producing elements (e.g., a micro-channel cooler); a plurality of light producing elements (e.g., arrays of LEDs); wire bonds included in circuits providing energy to the light producing elements. A gasket(s) is desirably provided between the replaceable assembly and a lamp head assembly. Such exemplary elements (perhaps without the gasket) may be pre-assembled together to form the replaceable assembly, with the design limiting access to certain components (e.g., the light producing elements, the wire bonds, etc.) of the replaceable assembly. The replaceable assembly may be relatively durable, and be easily stored and shipped.

The design of the replaceable assembly involves various fastening relationships (e.g., the fastening between the cooling structure and the reflector, the fastening between the driver circuits and the cooling structure (supporting the light producing elements)).

Through the use of the inventive replaceable assembly, a field replaceable kit provides a reasonable choice for a customer/operator; that is, a replacement assembly is provided to save time, money, and possible process down time. The replacement takes a very short time, and with proper training may be performed by the customer.

The field replaceable assembly designs described herein reflect a significant improvement for many industrial customers. For many years, customers have desired to perform their own maintenance on their application specific equipment (e.g., an ultraviolet LED based curing system), at least in part because of the demand to keep such equipment running. By providing the field replaceable assemblies described herein, customers are desirably able to perform certain maintenance functions, and to get their equipment back up and running quickly after a fault and/or failure.

Referring now to FIG. 1A, a light system 100 is shown. Light system 100 includes a lamp head assembly 102 and a replaceable assembly 104. In FIG. 1A, lamp head assembly 102 and replaceable assembly 104 are shown separated from one another. During operation of light system 100, assemblies 102, 104 are connected with gasket 106 provided therebetween as a sealant for a cooling fluid (e.g., chilled water provided by a cooling system). In operation, light system 100 may be used, for example, in connection with an application such as a UV curing application, or some other application. Additional elements of a curing system are omitted from the drawings for simplicity. For example, it is understood that elements of light system 100 (e.g., driver circuits 102*a*1, sometimes referred to as drive circuits, or drivers) may be controlled using a microprocessor (not shown in the drawings). Such driver circuits 102*a*1 provide energy to light producing elements 104*h*1 (see FIG. 1B, where the light producing elements 104*h*1 which may be arranged in a plurality of arrays) in replaceable assembly 104. Electrical energy is provided to the driver circuits 102*a*1 by a power source/supply (not shown). Additional details related to such driver circuits and other elements described herein may be found in U.S. Pat. No. 9,648,705, the content of which is incorporated by reference herein in its entirety.

Lamp head assembly 102 includes a circuit board 102*a* (for supporting driver circuits 102*a*1 for the light producing elements 104*h*1 of replaceable assembly 104). A cooling system of lamp head assembly 102 includes cooling fluid inlet and outlet connections 108 for providing cooling fluid from a cooling fluid source (e.g., a chilled water supply, not shown) to replaceable assembly 104. Cooling fluid extends from connections 108 to connection surface 102*c* of lamp head assembly 102. The cooling fluid exits (and re-enters) lamp head assembly 102 through inlet (and exit) ports 102*b* defined by connection surface 102*c*. The cooling fluid then enters a cooling structure 104*h* (described below in connection with FIG. 1B) of replaceable assembly 104, where gasket 106 provides a sealing function for the cooling fluid between lamp head assembly 102 and replaceable assembly 104.

Still referring to FIG. 1A, replaceable assembly 104 includes flanged portions 104*a* at a first end adjacent lamp head assembly 102, and an exit surface 104*b* (for light exiting light assembly 100, for example, to be used in a curing application) at a second end opposite the first end. Flanged portions 104*a* define a space for housing certain elements of replaceable assembly 104 within a footprint of replaceable assembly 104. Such elements may include, for example, light producing elements 104*h*1 (shown in FIG. 1B), bonding wires 104*h*4 on cooling structure 104*h* (shown in FIG. 1B in a simplified form), and connectors 104*i*1 (shown in FIG. 2) for connecting to electrical cables for carrying electrical signals from driver circuits 102*a*1 of lamp head assembly 102. Alignment structures 104*h*5 (e.g., pins) provided on cooling structure 104*h* are configured to be received by apertures (not shown) defined by wall portions 104*e* (see FIG. 1B), for providing alignment between cooling structure 104*h* and wall portions 104*e* (while protecting sensitive components such as bonding wires 104*h*4). Fasteners 104*c* extend through apertures 104*d*. When light assembly 100 is fully assembled (with lamp head assembly 102 and replaceable assembly 104 connected to one another), fasteners 104 are engaged with apertures 102*c* of lamp head assembly 102.

Fasteners 104*c* may be captive fasteners, adapted/configured to be held in connection with replaceable assembly 104. Further, fasteners 104*c* may be turnlock fasteners, and may be easily operated (e.g., without tools) to connect replaceable assembly 104 to lamp head assembly 102, or to disconnect the same. For example, if a fault/failure is detected by a customer/operator of light system 100, and if the customer/operator believes the fault/failure is related to a portion of replaceable assembly 104, the customer/operator may separate replaceable assembly 104 from lamp head assembly 102 through the operation of fasteners 104*c*. After the separation, a different (e.g., new) replaceable assembly 104 may be connected to the existing lamp head assembly 102 using fasteners 104*c* captive with the different (new) replaceable assembly 104.

Although fasteners 104*c* (e.g., captive fasteners, turnlock fasteners, etc.) are illustrated as being captive with respect to replaceable assembly 104—and configured to be engaged in apertures 102*c* of lamp head assembly 102—the invention is not limited thereto. For example, similar fasteners may be captive with respect to lamp head assembly 104, and configured to be engaged in apertures of replaceable assembly 104.

Figure 1B:
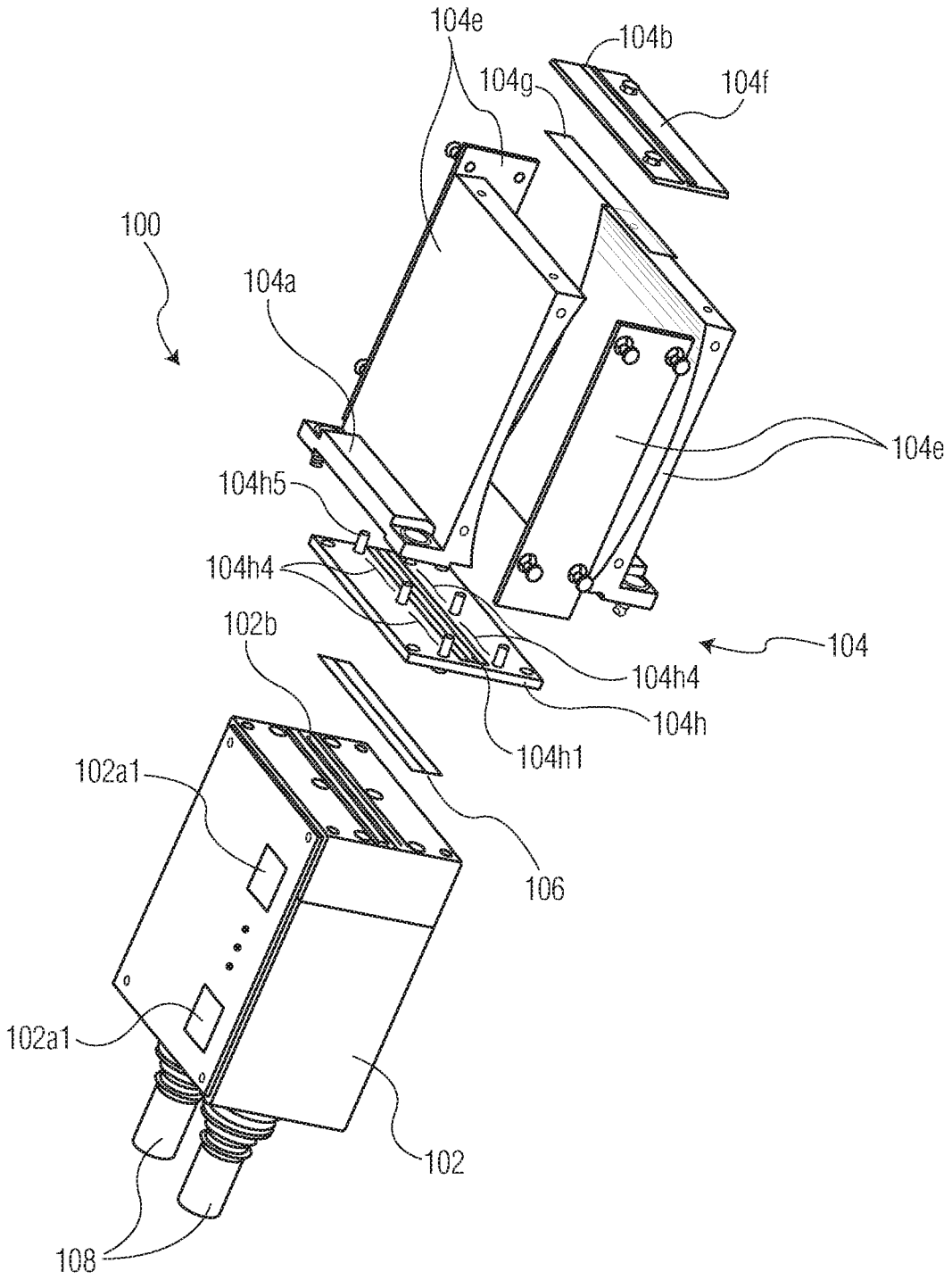
FIG. 1B is a perspective view of the light assembly of FIG. 1A with the replaceable assembly shown in an exploded configuration in accordance with an exemplary embodiment of the invention.

Referring now to FIG. 1B, replaceable assembly 104 is shown in an exploded configuration. Replaceable assembly 104 includes a plurality of wall portions 104*e* including reflective internal surfaces to create a reflector 104*i* when assembled as shown in FIG. 1A. Examples of reflectors that may be adapted for use in connection with the replaceable assemblies of the invention are shown in U.S. Patent Application Publication No. 2015/0378072, the content of which is incorporated by reference herein in its entirety.

Replaceable assembly 104 also includes window retainer 104*f* that retains window 104*g* in the assembled configuration of FIG. 1A. Replaceable assembly 104 also includes cooling structure 104*h*. Cooling structure 104*h* defines a plurality of cooling channels therein for receiving the cooling fluid from the cooling system of lamp head assembly 102. A plurality of light producing elements 104*h*1 (e.g., LED elements arranged in arrays) are provided on cooling structure 104*h*. Example of cooling structures (e.g., multichannel coolers) that may be adapted for use in connection with the invention are shown in U.S. Pat. No. 8,809,820, the content of which is incorporated by reference herein in its entirety.

Light from the light producing elements 104*h*1 reflects in the reflector defined by wall portions 104*e*, and exits replaceable assembly 104 through window 104*g*. Upon exiting replaceable assembly 104, the reflected light is provided for curing or other use.

Figure 2:
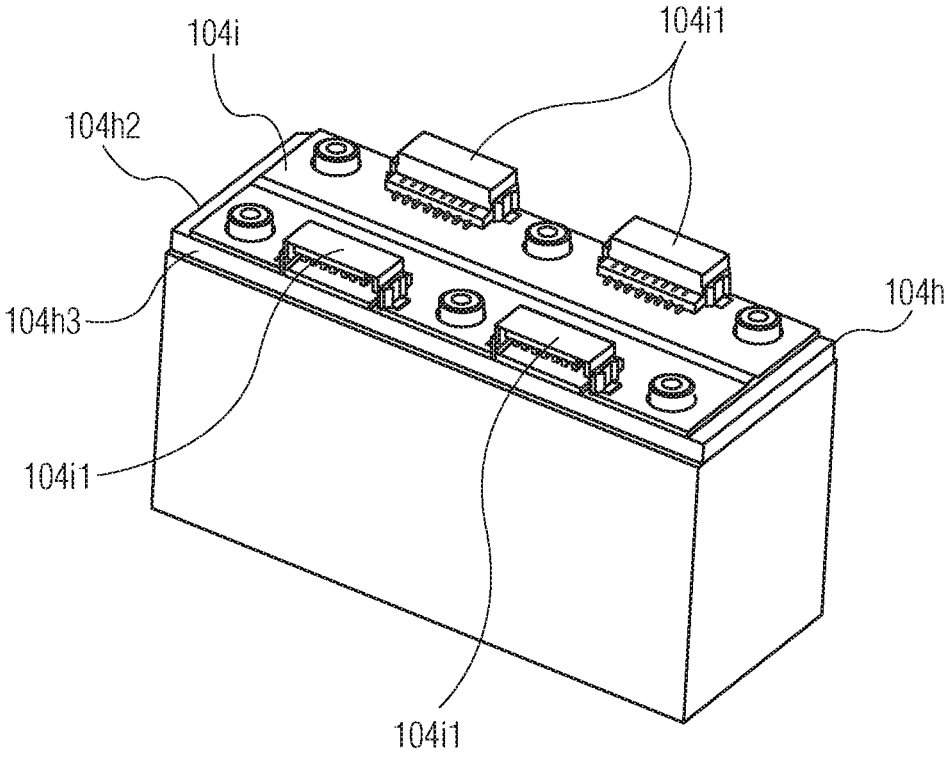
FIG. 2 is a top perspective view of elements of the replaceable assembly of FIGS. 1A-1B.

FIG. 2 illustrates an interface board 104*i* positioned on an upper surface 104*h*2 of cooling structure 104*h*. A lower surface 104*h*3 of cooling structure 104*h* is the side positioned adjacent lamp head assembly 102 when replaceable assembly 104 is connected to lamp head assembly 102 using fasteners 104*c*. Upper surface 104*h*2 is the surface of cooling structure visible in FIG. 1B (although interface board 104*i* is omitted from FIG. 1B). A plurality of connectors 104*i*1 are provided on interface board 104*i*. Electrical cables (not shown) provide electrical connections between the driver circuits 102*a*1 included in lamp head assembly 102 and corresponding electrical connectors 104*i*1. Thus, when it is desired to separate replaceable assembly 104 from lamp head assembly 102 (e.g., using fasteners 104*c*), after the separation, the electrical cables may be easily separated from connectors 104*i*1 (e.g., without tools).

Certain portions of replaceable assembly 104 tend to be more subject to potential damage if directly handled/contacted by customers/operators. Such portions include, for example, the light producing elements 104*h*1, bonding wires 104*h*4 on cooling structure 104*h* providing electrical connectivity to the plurality of light producing elements 104*h*1, connectors 104*i*1, among others. According to certain embodiments of the invention, these portions are not exposed to direct contact by the customer/operator. That is, as shown in FIG. 1A, certain areas of cooling structure 104*h* are within the "footprint" of replaceable assembly 104. Thus, when replaceable assembly 104 is removed from the lamp head assembly 102 (e.g., using fasteners 104*c*), these portions (e.g., light producing elements 104*h*1, bonding wires 104*h*4, etc.) are not handled by the customer/operator. The entire "faulty" replaceable assembly 104 may then be sent to the appropriate party (e.g., a manufacturer, a lab, a maintenance facility, etc.) for inspection, testing and/or repair—while another replacement assembly 104 may be connected to the existing lamp head assembly 102 by the customer/operator.

It is understood that the use of certain terms herein in the singular may refer to the plural, and vice versa. For example, the term "driver circuit" may refer to a plurality of driver circuits.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A light system comprising:

(a) a lamp head assembly, the lamp head assembly including (i) driver circuits, and (ii) a cooling system; and (b) a replaceable assembly connected to the lamp head assembly, the replaceable assembly including (i) a plurality of light producing elements, (ii) a cooling structure for receiving a cooling fluid from the cooling system, the plurality of light producing elements being supported by the cooling structure, and (iii) a reflector for receiving light from the plurality of light producing elements, wherein the replaceable assembly is separable, as a single assembly, from the lamp head assembly.

2. The light system of claim 1 wherein the plurality of light producing elements include at least one of ultraviolet LEDs or infrared light producing elements.

3. The light system of claim 1 wherein the plurality of light producing elements are arranged in a plurality of arrays of light producing elements in the replaceable assembly.

4. The light system of claim 3 wherein each of the driver circuits is configured to provide energy to at least a portion of the plurality of arrays of light producing elements.

5. The light system of claim 1 wherein the replaceable assembly is separable from the lamp head assembly using a plurality of fasteners disposed between the replaceable assembly and the lamp head assembly.

6. The light system of claim 5 wherein the plurality of fasteners are quick disconnect fasteners.

7. The light system of claim 5 wherein the plurality of fasteners are captive fasteners included as part of the replaceable assembly.

8. The light system of claim 5 wherein the plurality of fasteners are captive fasteners included as part of the lamp head assembly.

9. The light system of claim 5 wherein the plurality of fasteners are turn lock fasteners.

10. The light system of claim 1 wherein the replaceable assembly includes a plurality of electrical connectors configured for connection to electrical cables extending from the driver circuits to the replaceable assembly.

11. The light system of claim 10 wherein the electrical cables may be connected and disconnected from the connectors by an operator of the light assembly without the use of tools.

12. The light system of claim 1 wherein the cooling structure includes a plurality of wire bonds providing electrical connectivity to the plurality of light producing elements.

13. The light system of claim 12 wherein the plurality of wire bonds are contained within a footprint of the replaceable assembly.

14. The light system of claim 1 wherein the plurality of light producing elements are contained within a footprint of the replaceable assembly.

15. A method of assembling a light system, the method comprising the steps of:

(a) providing a lamp head assembly, the lamp head assembly including (i) driver circuits, and (ii) a cooling system; and (b) connecting a replaceable assembly to the lamp head assembly, the replaceable assembly including (i) a plurality of light producing elements, (ii) a cooling structure for receiving a cooling fluid from the cooling system, the plurality of light producing elements being supported by the cooling structure, and (iii) a reflector for receiving light from the plurality of light producing elements.

16. The method of claim 15 wherein step (b) includes connecting the replaceable assembly to the lamp head assembly using a plurality of fasteners disposed between the replaceable assembly and the lamp head assembly.

17. The method of claim 16 wherein the plurality of fasteners are quick disconnect fasteners.

18. The method of claim 16 wherein the plurality of fasteners are captive fasteners included as part of at least one of the replaceable assembly and the lamp head assembly.

19. The method of claim 16 wherein the plurality of fasteners are turn lock fasteners.

20. The method of claim 15 further comprising the step of (c) disconnecting the replaceable assembly, as a complete unit, from the lamp head assembly through the operation of a plurality of fasteners disposed between the replaceable assembly and the lamp head assembly.

* * * * *